US006869740B2

(12) United States Patent
Shindoh et al.

(10) Patent No.: US 6,869,740 B2
(45) Date of Patent: Mar. 22, 2005

(54) ELECTROPHOTOGRAPHIC PHOTORECEPTOR AND PRODUCTION METHOD THEREOF

(75) Inventors: Yuriko Shindoh, Yamatokoriyama (JP); Hiroko Ishibashi, Ikoma (JP); Kazushige Morita, Ikoma-gun (JP); Yoshihide Shimoda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/307,861

(22) Filed: Dec. 2, 2002

(65) Prior Publication Data

US 2003/0148199 A1 Aug. 7, 2003

(30) Foreign Application Priority Data

Dec. 4, 2001 (JP) ..... 2001-369882

(51) Int. Cl.[7] ..... G03G 5/047

(52) U.S. Cl. ..... 430/58.85; 430/58.05; 430/133

(58) Field of Search ..... 430/58.85, 133, 430/56, 58.05

(56) References Cited

U.S. PATENT DOCUMENTS 5,192,633 A * 3/1993 Iwasaki et al. ..... 430/58.45
5,445,909 A * 8/1995 Akasaki et al. ..... 430/58.8
5,641,598 A * 6/1997 Tanaka et al. ..... 430/58.85
5,654,481 A 8/1997 Anzai et al.
6,180,310 B1 * 1/2001 Pinsly ..... 430/131

FOREIGN PATENT DOCUMENTS

JP 09-230614 * 9/1997

* cited by examiner

*Primary Examiner*—John L Goodrow
(74) *Attorney, Agent, or Firm*—David G. Conlin; John B. Alexander; Edwards & Angell, LLP

(57) ABSTRACT

An electrophotographic photoreceptor, in which the increase of VL is controlled below 15 V by controlling the content ratio M (ppm) of a charge transporting material CTM2 to a charge transporting material CTM1 within a specific range, wherein the ionization potential Ip(2) of the CTM2 is smaller than the ionization potential Ip(1) of the CTM1 in the constituent of the photosensitive layer, and thereby the electrophotographic photoreceptor has only a little reduction of image concentration. A method for producing an electrophotographic photoreceptor having ΔVL which is controlled below 15 V, wherein, in a case where the ionization potential of the charge transporting material used in the previous run of production is small, ΔVL can be set below 15 V by using, in the next production, a dip coating liquid, which comprises, as a constitutive material, a charge transporting material in which the difference between the ionization potential of the current material and that of the previous material is set below 0.25 eV.

10 Claims, 4 Drawing Sheets

ELECTROPHOTOGRAPHIC PHOTORECEPTOR AND PRODUCTION METHOD THEREOF

BACKGROUND OF THE INVENTION

1. Field of the Invention

The present invention relates to an electrophotographic photoreceptor and a production method thereof. Specifically, the present invention relates to a photoreceptor in which a photosensitive layer containing an organic material is laminated on a conductive substrate, and a production method thereof.

2. Description of the Related Art

In recent years, a large number of organic electrophotographic photoreceptors made from organic photoconductive materials have been proposed and used in practice as an electrophotographic photoreceptor. This is because the organic electrophotographic photoreceptor is pollution-free and provides cost reduction and flexibility of selection of materials, and therefore various photoreceptor properties can be designed. The photosensitive layer of the organic electrophotographic photoreceptor mainly consists of a layer comprising an organic photoconductive material dispersed in a resin. There have been proposed many photoreceptors having structures such as a lamination structure consisting of a layer in which a charge generation material is dispersed in a resin (a charge generation layer, hereinafter referred to as "CGL") and a layer in which a charge transporting material is dispersed in a resin (a charge transport layer, hereinafter referred to as "CTL"); a monolayer structure in which a charge generation material (hereinafter referred to as "CGM") and a charge transporting material (hereinafter referred to as "CTM") are dispersed in a resin; and others. Of these, a functionally separated photoreceptor comprising a photosensitive layer formed by laminating a charge transport layer on a charge generation layer, is excellent in electrophotographic properties and durability, and is broadly used in practical applications.

In recent years, the miniaturization and speedup of a machine body including both a copying machine and a printer have been required. That is, all the properties of a photoreceptor such as longevity due to improved wear resistance, high sensitivity corresponding to speedup, resistance against hazardous ozone or nitrogen oxides generated by corona discharge and others, are required.

To meet these requirements, an electrophotographic photoreceptor with high sensitivity and excellent resistance to ozone or nitrogen oxides, which is formed of a charge transporting material having great ionization potential, has been studied and practically used.

Therefore, photoreceptor drums for use in both high-speed and low-speed machines are required, and so various types of photoreceptor drums having different properties such as durability or sensitivity need to be produced.

FIG. 1 is a view showing a dip coater used in the production of an electrophotographic photoreceptor. This dip coater is comprised of: a dip coating tank 4 which is filled with a dip coating liquid 5 prepared by dissolving a charge transport substance in a binder resin solution; an auxiliary tank 7 which connects to the dip coating tank 4 via a pump 6; an elevating machine 2 which moves a cylindrical conductive substrate 1 up and down; and a motor 3. As the dip coating liquid 5 is consumed in the dip coating tank 4, the dip coating liquid 5 pooled in the auxiliary tank 7 is supplied from a dip coating liquid supply port 14 to the dip coating tank 4 via the pump 6. When the dip coating liquid overflows the dip coating tank 4, it is received in an overflow tank 13 and is then transported to the auxiliary tank 7. The dip coating liquid 5 pooled in the auxiliary tank 7 is monitored for viscosity by a viscosity measuring device 10. Then, to maintain uniform viscosity, a dilution pooled in an addition solvent tank 9 is added to the dip coating liquid 5, and the mixture is stirred with an agitator 8. The cylindrical conductive substrate 1 is chucked by a cylindrical conductive substrate grasping part 11 and is moved in a vertical direction at a predetermined speed by the elevating machine 2 which comprises the motor 3. To form a photosensitive layer, the conductive substrate 1 is taken down and is immersed in the dip coating liquid 5 pooled in the dip coating tank 4 through the dip coating tank opening port 12. The well-dipped conductive substrate 1 is pulled out of the dip coating tank 4 by the elevating machine 2, so that a photosensitive layer is formed.

Where two or more types of electrophotographic receptors are produced by this dip coater using different charge transporting materials, it would be better if the dip coating tank 4, the auxiliary tank 7 and a circulating device such as a piping or pump could be prepared specifically for each of different charge transporting materials. But the fact is, considering cost reduction, various types of photoreceptor drums with different properties are produced in a single device. Accordingly, when a dip coating liquid is exchanged, a washing operation is required, in which the dip coating liquid used in the previous production is discharged, a washing solvent is poured and circulated in the dip coater, and the washing liquid is then discharged.

At this time, if the apparatus is completely disassembled, and hand wiping is then carried out using a cloth dampened with a washing solvent, the washing level can be raised. However, this washing operation requires considerable time and labor costs, and in fact some portions such as a pump or motor are incapable of being disassembled. Thus, the dip coating liquid used in the previous production inevitably remains. Moreover, when the circulation and discharge of a washing solvent is repeated, the washing level is raised on one hand, but a large amount of washing solvent and time are required on the other.

Japanese Patent Laid-Open No. 9-230614 proposes that, in an electrophotographic photoreceptor, the content of aromatic primary amine in a photosensitive layer thereof is set at 30 ppm or lower with respect to a charge transporting material having a group represented by the following general formula in a molecule thereof:

[Formula]

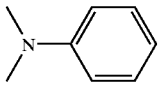

however, the allowance of impurities as a whole is not described in this publication.

The use of various types of photosensitive layers corresponding to different models in the production of an electrophotographic photoreceptor leads to the performance of dip coating using various types of dip coating liquid. Consequently, the circulating system of a dip coating liquid such as a dip coating tank or dip coating liquid agitating wagon, which is used in a production line, is cleaned and maintained, and by exchanging the dip coating liquids, dip coating is carried out using each dip coating liquid.

However, due to the exchange of dip coating liquid, in some cases, the thus produced electrophotographic photoreceptor cannot satisfy the required electric property. Even though electrophotographic receptors are produced under the same conditions, there is variation of the electric property between lots. In the case where such a photoreceptor is mounted, problems occur such that the surface potential VL of the photoreceptor increases after laser exposure and image concentration decreases.

For example, in the production of a photoreceptor (1) there was a great difference regarding electric property between a case where the photoreceptor (1) was produced after a photoreceptor (2) was produced, and a case where the photoreceptor (1) was produced after a photoreceptor (3) was produced. The results are shown in FIG. 2. The original electric property of the photoreceptor (1) was identical to that of the receptor (1) which was produced after the receptor (2), but where the receptor (1) was produced after the receptor (3), the surface potential was significantly deteriorated.

It was considered that some dip coating liquid remains in some portions incapable of being disassembled such as a filter or piping portion when the dip coating liquid for a charge transport layer is exchanged and maintained, and that the deterioration (increase) of the surface potential VL of the photoreceptor (1) produced after the photoreceptor (3) results from the mixing of such a residual dip coating liquid into the photoreceptor (3). As a result of studies, even where a small amount of CTM of the photoreceptor (3) was added in the charge transport layer of the photoreceptor (1), the deterioration of the surface potential appeared. However, when the CTM of the photoreceptor (2) was added therein at the same ratio, almost no deterioration appeared. As a result of further studies, it was found that the significant deterioration of surface potential occurs when CTM having a smaller ionization potential is added.

A charge transporting material, which is excellent in resistance to ozone or nitrogen oxides, is highly sensitive and has high ionization potential, has come to be used. Because of this, a charge transporting material with conventional low ionization potential used in dip coating in the previous production is likely to be mixed into a dip coating liquid for a charge transport layer, which comprises, as a constitutive substance, the above described material with high ionization potential, and then the material with low ionization potential is likely to act as charge traps. By this phenomenon, it is considered that the sensitivity of a photoreceptor drops and the deterioration of image concentration occurs.

Therefore, when a dip coating liquid is exchanged, a production apparatus needs to be fully washed so that the charge transporting material used in the previous production does not remain. However, a large amount of washing solvent is needed to raise the washing level and this leads to high cost, and further, as described above, some portions cannot be disassembled. Thus, the full washing of a production apparatus is extremely difficult.

SUMMARY OF THE INVENTION

The present inventors have intensively studied to solve the above described problems and have found that, when a charge transporting material CTM2 as an impurity has ionization potential Ip(2) which is smaller than the ionization potential Ip(1) of a charge transporting material CTM1, and the content ratio of the charge transporting material CTM2 to the charge transporting material CTM1 is defined as M (ppm), as both the difference ΔIp of these ionization potentials (ΔIp=Ip(1)−Ip(2)) and M increase, as shown in FIG. 3, sensitivity reduction, that is, ΔVL increases (wherein ΔVL=VL(CTM1+CTM2)−VL (only CTM1)).

Thus, where the difference ΔIp between the ionization potentials is great, sensitivity reduction ΔVL is also great even though only a little amount of residual dip coating liquid is mixed. When this sensitivity reduction ΔVL is equal to 15 V or greater, decrease of copy concentration occurs, and therefore ΔVL needs to be set below 15 V. More preferably, when ΔVL is set equal to or below 5 V, a stable image can be obtained with no decrease of concentration.

As a result of further studies, the present inventors have found that ΔVL can be set below 15 V if M1 is set within a range shown in the following formula (1) and FIG. 4(A), and further that ΔVL can be set below 5 V if M2 is set within a range shown in the following formula (2) and FIG. 4(B), and thereby a photoreceptor shows a stable electric property:

$$M1 \leqq 0.29 \times \Delta Ip^{-5.4} \quad \text{Formula (1)}$$

$$M2 \leqq 0.10 \times \Delta Ip^{-5.4} \quad \text{Formula (2)}$$

provided that ΔIp=Ip(1)−Ip(2), M1 (ppm)=CTM2/CTM1 and M2 (ppm)=CTM2/CTM1.

Where a charge transporting material, which has ionization potential greater than that of the previously used charge transporting material, is used in the next production, it is necessary to perform a thorough cleaning. However, it is difficult to perform a thorough cleaning of the inside of a filter, piping or pump.

FIG. 5 shows the relationship between the number of washing when a dip coating liquid is exchanged and the remaining ratio of a charge transporting material used in the previous production. When washing is repeated, the remaining ratio decreases, but then a large amount of washing solvent and time are required, resulting in an increase in cost.

Considering the relationship among formula (1), FIGS. 4(A) and 5, and the relationship among formula (2), FIGS. 4(B) and 5, the present inventors have found that when the ionization potential of the charge transporting material used in the previous production is small, ΔVL can be set below 15 V if a dip coating liquid is used in the next production, which comprises, as a constitutive material, a charge transporting material in which the difference between the ionization potential of the charge transporting material and the ionization potential in the previous production is set below 0.25 eV, and further that ΔVL can be set below 5 V if the difference is set below 0.20 eV. The present inventors have found that, in the above cases, although washing is not fully carried out and some residual dip coating liquid remains, an electrophotographic photoreceptor retaining its performance can be produced, and they thereby completed the present invention. In view of the current situation, it is the object of the present invention to provide an electrophotographic photoreceptor in which washing costs are reduced when the dip coating liquid is exchanged, even where the previous dip coating liquid possibly containing a charge transporting material having small ionization potential is mixed into the new dip coating liquid, such that the electrophotographic photoreceptor retains good property and is excellent in resistance to ozone or nitrogen oxides.

That is to say, the present invention is an electrophotographic photoreceptor comprising a photosensitive layer, wherein, in the constituents of the above photosensitive layer, the ionization potential Ip(2) of a charge transporting material CTM2 is smaller than the ionization potential Ip(1) of a charge transporting material CTM1, and the content ratio M1 (ppm) of the CTM2 to the CTM1 is within the range represented by the following formula (1):

$$M1 \leqq 0.29 \times \Delta Ip^{-5.4} \quad \text{Formula (1)}$$

provided that ΔIp=Ip(1)−Ip(2), Ip(1)>Ip(2).

Moreover, the present invention is an electrophotographic photoreceptor wherein the content ratio M2 (ppm) is within the range represented by the following formula (2):

$$M2 \leqq 0.10 \times \Delta Ip^{-5.4} \quad \text{Formula (2)}$$

provided that ΔIp=Ip(1)−Ip(2), Ip(1)>Ip(2).

Furthermore, the above described electrophotographic photoreceptor is a laminated photoreceptor which comprises a photosensitive layer consisting of at least a charge generation layer and a charge transport layer, and the above described electrophotographic photoreceptor comprises an amine derivative represented by the following general formula [1] as the charge transporting material CTM1:

[Formula]

[1]

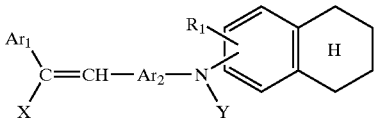

wherein $Ar_1$ shows an aryl group which may have a substituent, $Ar_2$ shows a phenylene, naphthylene, biphenylene or anthrylene group which may have a substituent, $R_1$ shows a hydrogen atom, lower alkyl group or lower alkoxy group, X shows a hydrogen atom, alkyl group which may have a substituent, or aryl group which may have a substituent, and Y shows an aryl group which may have a substituent, or monovalent group represented by the following general formula [2]:

[Formula]

[2]

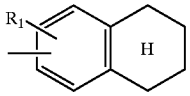

wherein $R_1$ shows the same group as described above.

Still more, the present invention is a method for producing two or more types of electrophotographic photoreceptors using a single production apparatus and different charge transporting materials, wherein the difference ΔIp between the ionization potential Ip(1) of a charge transporting material CTM1 and the smaller ionization potential Ip(2) of a charge transporting material CTM2 which is used for the previous production, is represented by the following formula (3):

$$\Delta Ip \leqq 0.25\ eV \quad \text{Formula (3)}$$

provided that ΔIp=Ip(1)−Ip(2), Ip(1)>Ip(2).

Still further, the present invention is a method for producing two or more types of electrophotographic photoreceptors using a single production apparatus and different charge transporting materials, wherein the difference ΔIp between the ionization potential Ip(1) of a charge transporting material CTM1 and the smaller ionization potential Ip(2) of a charge transporting material CTM2 which is used for the previous production, is represented by the following formula (4):

$$\Delta Ip \leqq 0.20eV \quad \text{Formula (4)}$$

provided that ΔIp=Ip(1)−Ip(2), Ip(1)>Ip(2).

Still further, the present invention is the above described method for producing an electrophotographic photoreceptor, wherein the electrophotographic photoreceptor is a laminated photoreceptor comprising a photosensitive layer consisting of at least a charge generation layer and a charge transport layer, and wherein the electrophotographic photoreceptor comprises an amine derivative represented by the following general formula [1] as the charge transporting material CTM1:

[Formula]

[1]

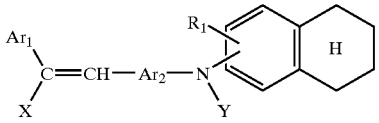

wherein $Ar_1$ shows an aryl group which may have a substituent, $Ar_2$ shows a phenylene, naphthylene, biphenylene or anthrylene aryl group which may have a substituent, $R_1$ shows a hydrogen atom, lower alkyl group or lower alkoxy group, X shows a hydrogen atom, alkyl group which may have a substituent, or aryl group which may have a substituent, and Y shows an aryl group which may have a substituent, or monovalent group represented by the following general formula [2]:

[Formula]

[2]

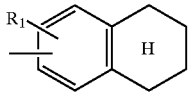

wherein $R_1$ shows the same group as described above.

DETAILED DESCRIPTION OF THE PREFERRED EMBODIMENTS

Figure 1:
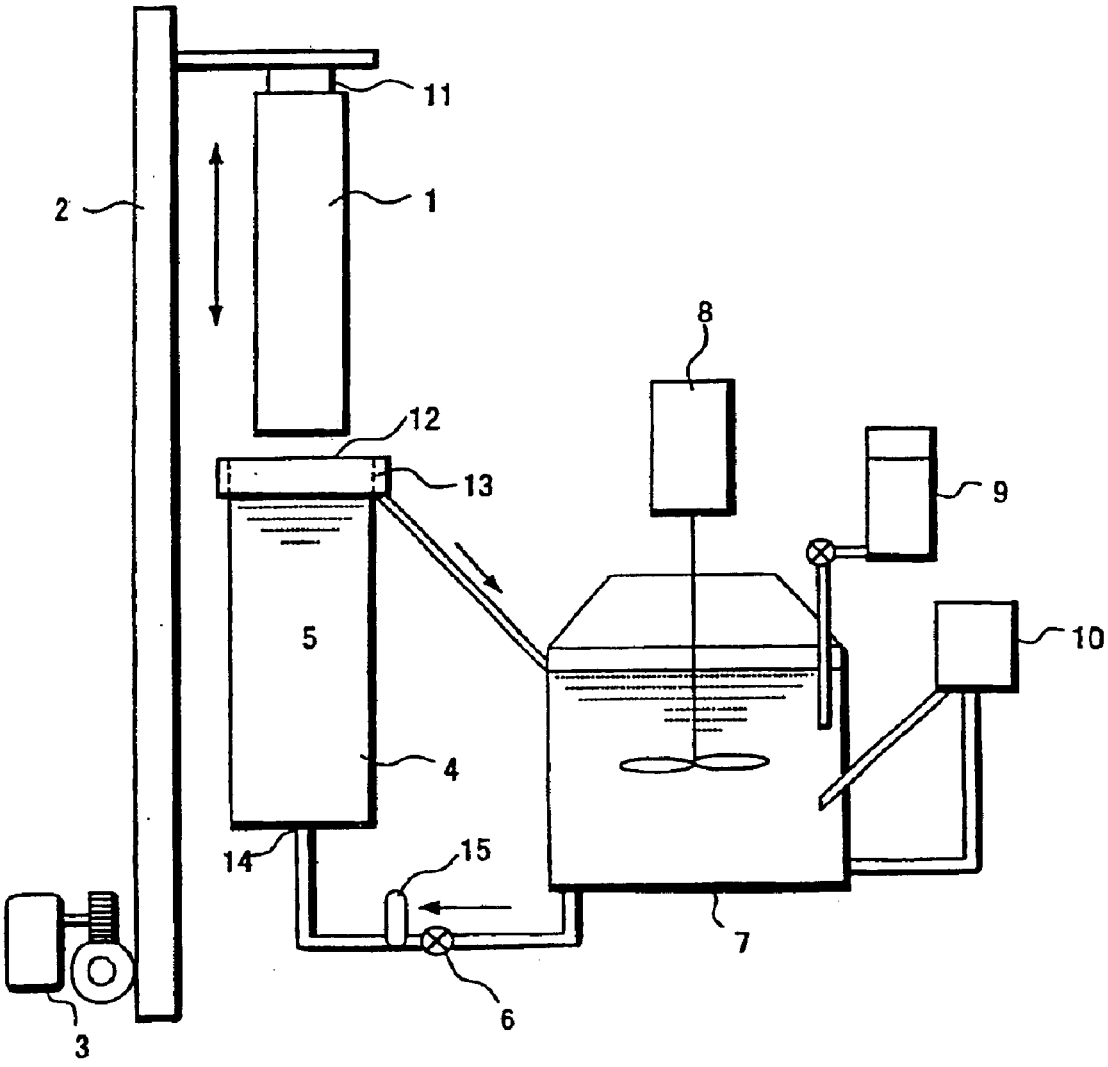
FIG. 1 is a schematic diagram of a dip coater for an electrophotographic photoreceptor.
Figure 2:
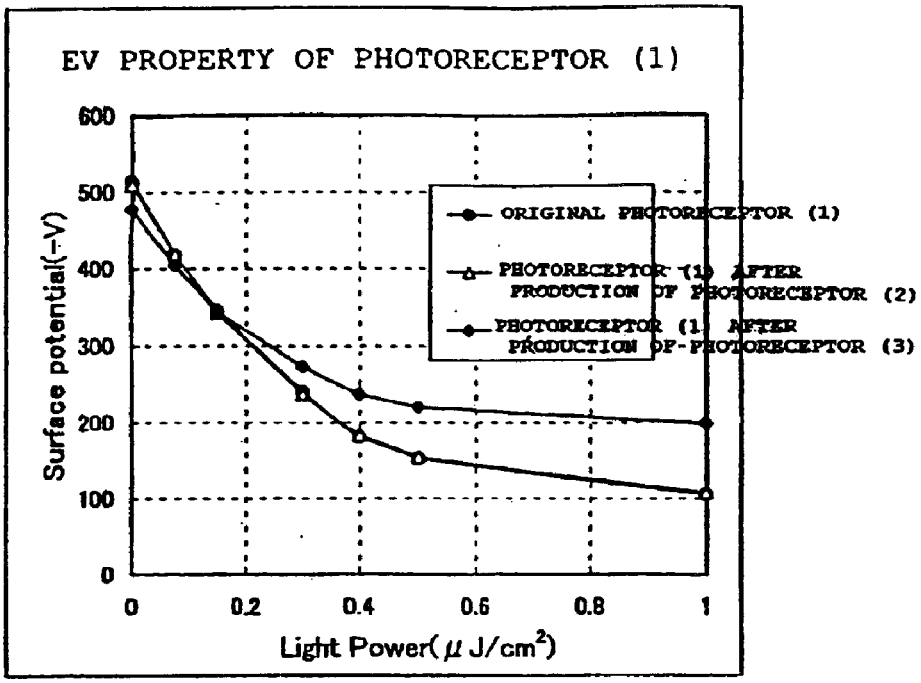
FIG. 2 is a view showing the results of the electric property of a photoreceptor (1) in both cases where the photoreceptor (1) is produced after the production of a photoreceptor (2) and where the photoreceptor (1) is produced after the production of a photoreceptor (3)
Figure 3:
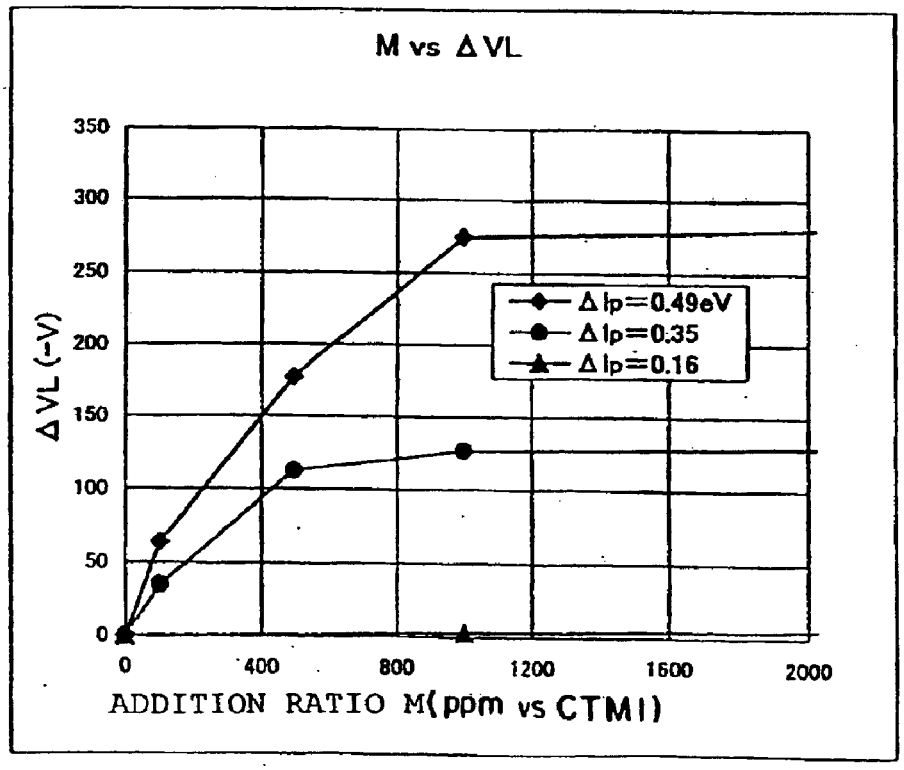
FIG. 3 is a view showing the relationship between the content ratio M (ppm) of a charge transporting material CTM2 to a charge transporting material CTM1 and the difference ΔIp of both ionization potentials.

The materials of the organic electrophotographic photoreceptor of the present invention will be explained.

A substrate may be a material having conductivity, and examples of such a substrate may include metal and alloy materials such as aluminum, copper, brass, zinc, nickel, stainless steel, chromium, molybdenum, vanadium, indium, titanium, gold and platinum. Moreover, such examples may also include a polyester film, a paper and a metallic film to which aluminum, aluminum alloy, tin oxide, gold or indium oxide is evaporated or applied; a plastic or paper containing conductive particles; a plastic containing conductive polymers; and others. These materials are processed into a cylindrical, columnar or thin-film sheet form before use. In particular, the conductive substrate used in the present invention preferably adopts a cylindrical form.

When a photosensitive layer is formed, in some cases, an undercoating layer may be formed between a conductive substrate and a charge generation layer or charge transport layer for the reasons such as the coating of flaw and asperities of a conductive substrate, the prevention of deterioration by static electricity in repeated use, the improvement of an electrostatic property under the environment of a low temperature or low humidity.

Examples of an undercoating layer generally used include an inorganic layer such as an aluminum anodic oxide film, aluminum oxide or aluminum hydroxide; an organic layer such as polyvinyl alcohol, casein, polyvinyl pyrrolidone, polyacrylic acid, celluloses, gelatin, starch, polyurethane, polyimide or polyamide; and a layer obtained by adding, as an inorganic pigment, the conductive or semi-conductive particles of metal such as aluminum, copper, tin, zinc or titanium, or metal oxide such as zinc, aluminum oxide or titanium oxide to an organic layer. Examples of the crystal type of titanium oxide include an anatase form, a rutile form, an amorphous form and others, and any of these forms may be used, or two or more types may be used in combination. The surface of a titanium oxide particle is preferably coated with a metal oxide such as $Al_2O_3$, $ZrO_2$ or a mixture thereof. Examples of a binder resin contained in an undercoating layer include resins such as polyvinyl alcohol, casein, polyvinyl pyrrolidone, polyacrylic acid, celluloses, gelatin, starch, polyurethane, polyimide and polyamide, and preferably a polyamide resin is used. The reason for the use of a binder resin is that the resin is not dissolved or does not swell in a solvent used for forming a photoreceptor layer on an undercoating layer, or it has an excellent adhesive property to a conductive supporting medium and flexibility. Of polyamide resins, an alcohol soluble nylon resin can preferably be used. Examples of such a nylon resin include what is called copolymer nylon such as nylon 6, nylon 66, nylon 610, nylon 11 or nylon 12, and chemically denatured nylon such as N-alkoxymethyl denatured nylon or N-alkoxyethyl denatured nylon.

Examples of an organic solvent used as a dip coating liquid for an undercoating layer in the present invention include an ordinary solvent. Where alcohol soluble nylon resin is preferably used as a binder resin, the organic solvent used therewith preferably comprises lower alcohols containing 1 to 4 carbon atoms and a single or mixed organic solvents selected from a group consisting of other organic solvents such as dichloromethane, chloroform, 1,2-dichloroethane, 1,2-dichloropropane, toluene, tetrahydrofuran, 1,3-dioxolane and others. When compared with the use of a single alcohol solvent, the mixing use of the above organic solvents improves the dispersibility of titanium oxide, and the long-term stable conversation of and the regeneration of a dip coating liquid become possible. Moreover, when a conductive supporting medium is immersed in a dip coating liquid for an undercoating layer so as to form an undercoating layer, the mixing use of the organic solvents prevents the coating defect and unevenness of the undercoating layer, and thereby a photosensitive layer can uniformly be applied and formed on the undercoating layer, so that an electrophotographic photoreceptor having an extremely excellent image property with no film defect can be produced.

To produce an undercoating layer, a solvent and a binder resin are initially added to the above described inorganic pigment, and the mixture is then dispersed using a dispersing machine such as a ball mill, Dino-mill or ultrasonic oscillator so as to obtain a dip coating liquid for an undercoating layer. Thereafter, using the dip coating liquid thus obtained, an undercoating layer is produced using a baker applicator, bar coater, casting or spin coating and others in the case of undercoating a sheet, whereas, the layer is produced by spray method, vertical ring method, dip coating method and others in the case of undercoating a drum.

The photosensitive layer of the organic electrophotographic photoreceptor of the present invention mainly comprises a layer obtained by dispersing an organic photoconductive material in a resin, and the photosensitive layer adopts a lamination structure laminating a layer in which a charge generation material is dispersed in a resin and a layer in which a charge transporting material is dispersed in a resin; a monolayer structure in which both a charge generation material and a charge transporting material are dispersed in a resin; and others. Of these, a functionally separated photoreceptor comprising a photosensitive layer formed by laminating a charge transport layer on a charge generation layer, is excellent in electrophotographic properties and durability, and so it is preferable.

A charge generation layer comprises, as a main ingredient, a charge generation material which generates electric charge through light irradiation, and also comprises a known binder, plasticizer or sensitizer as necessary. Examples of a charge generation material include a perylene pigment such as peryleneimide or perylenic acid anhydride; a polycyclic quinone pigment such as quinacridon or anthraquinone; a phthalocyanine pigment such as metal or non-metal phthalocyanine or halogenated non-metal phthalocyanine; an azo pigment comprising a squarium, azulenium or thiapyrylium pigment and a carbazole, styrylstilbene, triphenylamine, dibenzothiophene, oxadiazole, fluorenone, bisstilbene, distyryloxadiazole or distyrylcarbazole skeleton; and others. Examples of a pigment having a particularly high ability to generate electric charge include a non-metal phthalocyanine pigment, an oxotitanyl phthalocyanine pigment, a bisazo pigment containing a fluorine ring and a fluorenone ring, a bisazo pigment comprising an aromatic amine and a trisazo pigment, and using these pigments, a photoreceptor having high sensitivity can be provided.

Examples of a binder resin used for a binder resin solution include a melamine resin, an epoxy resin, a silicon resin, a polyurethane resin, an acryl resin, a vinyl chloride-vinyl acetate copolymer resin, a polycarbonate resin, a phenoxy resin, polyvinyl butyral resin, a polyarylate resin, a polylamide resin, a polyester resin and others. Examples of a solvent dissolving the above resins include ketones such as acetone, methyl ethyl ketone and cyclohexanone, esters such as ethyl acetate and butyl acetate, ethers such as tetrahydrofuran and dioxane, aromatic hydrocarbons such as benzene, toluene and xylene, aprotic polar solvents such as N,N-dimethylformamide and dimethylsulfoxide, and others.

Examples of a method for producing a charge generation layer include a method of directly forming a film on a compound by vacuum evaporation and a method of dispersing a charge generation substance in a binder resin solution and forming a film. The latter method is structurally preferable, and such a method of mixing and dispersing a charge generation substance in a binder resin solution for dip coating is the same as the above described method for producing an undercoating layer. The ratio of a charge generation material in a charge generation layer is preferably within a range of 30 to 90% by weight. The thickness of a charge generation layer is 0.05 to 5 $\mu$m, and preferably 0.1 to 2.5 $\mu$m.

A charge transport layer formed on a charge generation layer comprises, as essential ingredients, a charge transporting material having an ability to receive electric charge generated from a charge generation material and to transport the electric charge, and a binder, and further comprises a known plasticizer, sensitizer, lubricant and others as necessary. Examples of a charge transporting material include poly-N-vinyl carbazole and a derivative thereof, poly-$\gamma$-carbazolylethyl glutamate and a derivative thereof, a pyrene-formaldehyde condensation product and a derivative thereof, polyvinyl pyrene, polyvinyl phenanthrene, an oxazole derivative, an oxadiazole derivative, an imidazole derivative, 9-(p-diethylaminostyryl)anthracene, 1,1-bis(4-dibenzylaminophenyl)propane, styrylanthracene, styrylpyrazoline, a pyrazoline derivative, phenylhydrazones, a hydrazone derivative, a triphenylamine compound, a tetraphenyldiamine compound, a triphenylmethane compound, a stilbene compound, an electron-donating substance such as an azine compound having a 3-methyl-2-benzothiazoline ring, a fluorenone derivative, a dibenzothiophene derivative, an indenothiophene derivative, a phenanthrenequinone derivative, an indenopyridine derivative, a thioxanthone derivative, a benzo [c] cinnoline derivative, a phenazine oxide derivative, an electro-donating substance such as tetracyanoethylene, tetracyanoquinodimethane, promanyl, chloranil or benzoquinone, and others. Since the amine derivative represented by general formula [1] has a high hole transport property, it has high mobility and can maintain high sensitivity. Moreover, the amine derivative is not easily impaired by compounds such as ozone or nitrogen oxides.

A binder resin constituting a charge transport layer may be a resin having compatibility with a charge transporting material, and examples of such a binder resin include polycarbonate, a polycarbonate copolymer, polyarylate, polyvinyl butyral, polyamide, polyester, polyketone, an epoxy resin, polyurethane, polyvinyl ketone, polystyrene, polyacrylamide, a phenol resin, a phenoxy resin, a polysulfone resin and a copolymer resin thereof. These compounds may be used singly, or two or more of these compounds may be used in combination. In consideration of a film-forming property, wear resistance and an electric property, bisphenol-Z-polycarbonate or the mixture of bisphenol-Z-polycarbonate and another polycarbonate(s) is particularly preferable. Especially in the present invention, a mixture of a copolymer resin of bisphenol-A-polycarbonate and biphenyl with bisphenol-Z-polycarbonate, and a mixture of a copolymer resin of bisphenol-A-polycarbonate, biphenyl and polysiloxane with bisphenol-Z-polycarbonate, are preferable.

Examples of a solvent dissolving these materials include alcohols such as methanol and ethanol, ketones such as acetone, methyl ethyl ketone and cyclohexanone, ethers such as ethyl ether and tetrahydrofuran, aliphatics such as chloroform, dichloroethane and dichloromethane, aromatics such as halogenated hydrocarbon, benzene, chlorobenzene and toluene, and others. An antioxidant such as vitamin E, hydroquinone, hindered amine, hindered phenol, paraphenylene diamine, arylalkane and a derivative thereof, an organic sulfur compound, an organic phosphorous compound and others may be mixed to the dip coating liquid for a charge transport layer of the present invention.

The dip coating liquid for a charge transport layer is produced by dissolving a charge transport substance in a binder resin solution. As a method of applying the dip coating liquid, the same method as used for an undercoating layer and a charge generation layer can be used. The thickness of a film is 10 to 50 $\mu$m, and preferably 15 to 40 $\mu$m.

These photosensitive layers are successively coated and formed by the above described method, or each of these layers is dried using a dryer with hot air or far-infrared radiation so as to form a photoreceptor. The drying is performed preferably at 40° C. to 130° C. for 10 minutes to 2 hours.

Figure 6:
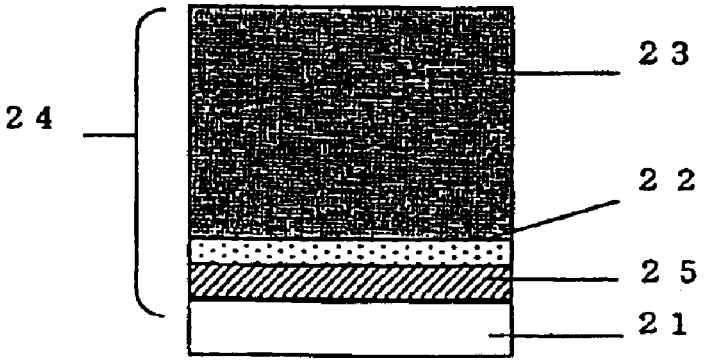
FIG. 6 is a schematic cross-sectional view of a functionally separated photoreceptor, which is one embodiment of the present invention.

FIG. 6 shows a schematic cross-sectional view of a functionally separated photoreceptor, which is one embodiment of the present invention. In the figure, reference numeral 21 denotes a conductive supporting medium (substrate), 22 denotes a charge generation layer, 23 denotes a charge transport layer, 24 denotes a photosensitive layer, and 25 denotes an undercoating layer.

Where various types of photoreceptors are produced, it is desired that a production planning is made so that the difference of ionization potentials becomes small, for example, such that the production is carried out in the order of (1) CTM3, (2) CTM2 and (3) CTM1 when the ionization potential of CTM used is Ip (CTM1)>Ip (CTM2)>Ip (CTM3). Thus, although CTM used in the previous production is somewhat mixed, sensitivity reduction does not occur. Moreover, where the production is carried out in the order of (1) CTM3 and then (2) CTM1, cleaning is sufficiently carried out so that the content ratio becomes within a range of formula (1) and preferably formula (2), and the sensitivity reduction is thereby prevented.

Furthermore, where various types of photoreceptors are produced using a single production apparatus and different charge transporting materials, considering the difference of ionization potentials of these materials, the order of production is determined so that the difference becomes within 0.25, and preferably within 0.20. By this, washing cost can be reduced when a dip coating liquid is exchanged, and further an electrophotographic photoreceptor, which maintains good properties and has an excellent resistance to ozone or nitrogen oxides, can be obtained. For example, when the ionization potential of CTM used is Ip (CTM1)>Ip (CTM2)>Ip (CTM3), if the difference of the ionization potentials of CTM1 and CTM3 is more than 0.25 and the differences of the ionization potentials of CTM1 and CTM2, and CTM2 and CTM3 are both within 0.25, it is better that the production is not carried out in the order of (3) CTM3 and directly (1) CTM1, but is carried out in the order of (3) CTM3, (2) CTM2 and (1) CTM1.

EXAMPLES

The present invention will be described further in detail in the following examples. However, the examples are provided for illustrative purposes only, and are not intended to limit the scope of the present invention.

Reference Example 1

A ϕ40 mm×L340 mm aluminum cylindrical tube was used as a conductive supporting medium. Four parts by weight of titanium oxide particles and 6 parts by weight of copolymer nylon resin (Toray Industries, Inc., Trade name: CM8000) as a binder resin were added to a mixed solvent of 35 parts by weight of methyl alcohol and 65 parts by weight of 1,2-dichloroethane, and then the mixed solvent was dispersed with a paint shaker for 8 hours to obtain a dip coating liquid for an undercoating layer. The obtained dip coating liquid was poured into a tank. Thereafter, the above aluminum cylindrical supporting medium was immersed in dip coating liquid and then removed therefrom followed by coating, so that a 0.9 μm undercoating layer was formed on the aluminum drum. The solvent was evaporated when it was dried, while the titanium oxide particles and the copolymer nylon resin remained as an undercoat layer. Accordingly, the content of the titanium oxide particles was 40% by weight and the content of the binder resin was 60% by weight.

Subsequently, 2 parts of oxotitanyl phthalocyanine pigment wherein Bragg angle (2θ±0.20) of CuKα.characteristic X-ray diffraction has a sharp peak at least at 27.30, 1 part of polyvinyl acetal resin (Sekisui Chemical Co., Ltd., Trade name: S-Lec B), and 97 parts of 1,3-dioxolane were dispersed with a ball mill dispersing machine for 12 hours to prepare a dispersion liquid. After a tank was filled with this dispersion liquid, the above described aluminum drum having an undercoating layer formed thereon was immersed in the dispersion liquid, and then removed therefrom followed by dip coating, so that a charge generation layer having a thickness of about 0.2 μm was formed on the undercoating layer. Moreover, 100 parts by weight of a compound (1) represented by the below described general formula and 160 parts by weight of polycarbonate resin (Mitsubishi Engineering-Plastics Corp., Tradename: Iupilon (Z-200)) were mixed to 1,200 parts by weight of tetrahydrofuran to prepare a dip coating liquid applied for a charge transport layer. On the charge generation layer as formed above, the dip coating liquid applied for the charge transport layer was applied by immersion, and then drying was carried out at 110° C. for 1 hour so as to form a charge transport layer having a thickness of about 23 μm, and thus a laminated, functionally separated photoreceptor was produced. Herein, the amount of a solvent was altered as appropriate depending on the viscosity or the coating property. The Ip of a compound (1) represented by the following general formula was 5.58 eV.

[Formula]

(1)

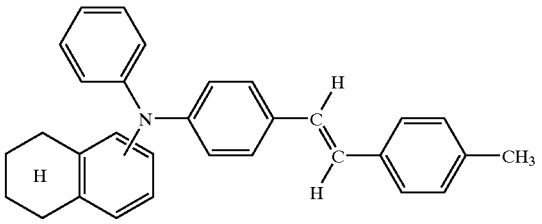

Reference Example 2

A photoreceptor was produced in the same manner as in Reference example 1 with the only exception that a compound (2) represented by the following general formula was used as a charge transporting material. The Ip of the compound (2) represented by the following general formula was 5.42 eV.

[Formula]

(2)

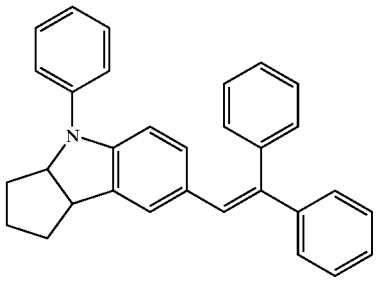

Reference Example 3

A photoreceptor was produced in the same manner as in Reference example 1 with the only exception that a compound (3) represented by the following general formula was used as a charge transporting material. The Ip of the compound (3) represented by the following general formula was 5.23 eV.

[Formula]

(3)

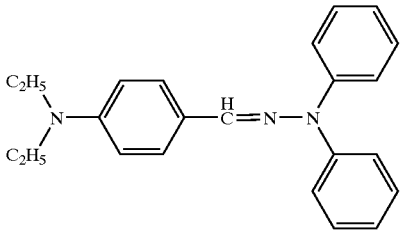

Reference Example 4

A photoreceptor was produced in the same manner as in Reference example 1 with the only exception that a compound (4) represented by the following general formula was used as a charge transporting material. The Ip of the compound (4) represented by the following general formula was 5.06 eV.

[Formula]

(4)

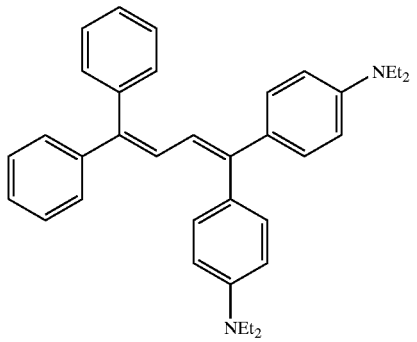

Example 1

A photoreceptor was produced in the same manner as in Reference example 1 with the only exception that 100 parts by weight of the compound (1) and 0.75 parts by weight of the compound (2) were used as charge transporting materials.

Example 2

A photoreceptor was produced in the same manner as in Reference example 1 with the only exception that 100 parts by weight of the compound (1) and 0.0045 parts by weight of the compound (3) were used as charge transporting materials.

Example 3

A photoreceptor was produced in the same manner as in Reference example 1 with the only exception that 100 parts by weight of the compound (1) and 0.0025 parts by weight of the compound (4) were used as charge transporting materials.

Example 4

A photoreceptor was produced in the same manner as in Reference example 1 with the only exception that 100 parts by weight of the compound (1) and 0.25 parts by weight of the compound (2) were used as charge transporting materials.

Example 5

A photoreceptor was produced in the same manner as in Reference example 1 with the only exception that 100 parts by weight of the compound (1) and 0.0015 parts by weight of the compound (3) were used as charge transporting materials.

Example 6

A photoreceptor was produced in the same manner as in Reference example 1 with the only exception that 100 parts by weight of the compound (1) and 0.0005 parts by weight of the compound (4) were used as charge transporting materials.

Example 7

A photoreceptor was produced in the same manner as in Reference example 1 with the only exception that 100 parts by weight of the compound (2) and 0.075 parts by weight of the compound (3) were used as charge transporting materials.

Example 8

A photoreceptor was produced in the same manner as in Reference example 1 with the only exception that 100 parts by weight of the compound (3) and 0.4 parts by weight of the compound (4) were used as charge transporting materials.

Comparative Example 1

A photoreceptor was produced in the same manner as in Reference example 1 with the only exception that 100 parts by weight of the compound (1) and 4 parts by weight of the compound (2) were used as charge transporting materials.

Comparative Example 2

A photoreceptor was produced in the same manner as in Reference example 1 with the only exception that 100 parts by weight of the compound (1) and 0.055 parts by weight of the compound (3) were used as charge transporting materials.

Comparative Example 3

A photoreceptor was produced in the same manner as in Reference example 1 with the only exception that 100 parts by weight of the compound (1) and 0.01 parts by weight of the compound (4) were used as charge transporting materials.

The ionization potential of each compound used in the present examples and comparative examples was determined using a surface analyzer (Riken Keiki Co., Ltd., Trade name: AC-1). The ionization potential value of each compound is shown in

TABLE 1

Ionization potential of each compound

| | Ip (eV) |
|---|---|
| Compound (1) | 5.58 |
| Compound (2) | 5.42 |
| Compound (3) | 5.23 |
| Compound (4) | 5.06 |

The thus produced electrophotographic photoreceptors were mounted on full-color copiers with a tandem processing system (Sharp Corp., modified AR-C150). Then, the surface potential VL of each photoreceptor after laser exposure was determined in dark with no exposure process so as to examine the surface potential of each photoreceptor, that is, the electrification in its developing portion. The results are shown in Table 2. Herein, $\Delta Ip=Ip(1)-Ip(2)$, and $\Delta VL=VL(CTM1+CTM2)-VL$ (only CTM1).

TABLE 2

| | CTM1 | CTM2 | ΔIp (eV) | Addition ratio M (ppm) | Initial ΔVL (V) | Region |
|---|---|---|---|---|---|---|
| Reference example 1 | Compound (1) | — | — | 0 | — | — |
| Reference example 2 | Compound (2) | — | — | 0 | — | — |
| Reference example 3 | Compound (3) | — | — | 0 | — | — |
| Reference example 4 | Compound (4) | — | — | 0 | — | — |
| Example 1 | Compound (1) | Compound (2) | 0.16 | 7500 | 15 | A |
| Example 2 | Compound (1) | Compound (3) | 0.35 | 45 | 15 | A |
| Example 3 | Compound (1) | Compound (4) | 0.49 | 25 | 15 | A |
| Example 4 | Compound (1) | Compound (2) | 0.16 | 2500 | 5 | A, C |
| Example 5 | Compound (1) | Compound (3) | 0.35 | 15 | 5 | A, C |
| Example 6 | Compound (1) | Compound (4) | 0.49 | 5 | 5 | A, C |
| Example 7 | Compound (2) | Compound (3) | 0.19 | 750 | 5 | A, C |
| Example 8 | Compound (3) | Compound (4) | 0.14 | 4000 | 5 | A, C |
| Comparative example 1 | Compound (1) | Compound (2) | 0.16 | 40000 | 100 | B |
| Comparative example 2 | Compound (1) | Compound (3) | 0.35 | 550 | 100 | B |
| Comparative example 3 | Compound (1) | Compound (4) | 0.49 | 100 | 100 | B |

Figure 4A:
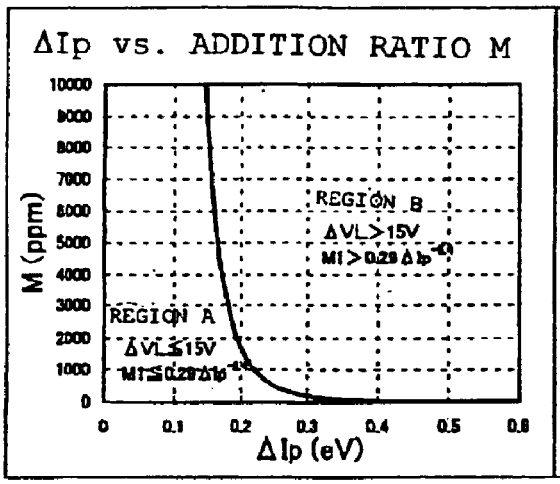
FIG. 4(A) is a view showing both a region A where the difference ΔVL of surface potentials which satisfies formula (1) is 15 V or smaller and a region B where the difference is equal to 15 V or greater.

Thus, the VL difference between the samples of Examples 1 to 8, which located in region A in FIG 4(A) satisfying formula (1), and, the samples of Reference examples 1 to 4, which comprised only CTM1 with no mixing of CTM2, was below 15 V, and therefore the reduction of image concentration of the samples of Examples 1 to 8 was at an acceptable level. In contrast, the samples of Comparative examples 1 to 3, which located in region B in FIG. 4 (A) not satisfying formula (1), had a significant increase of VL, and the image concentration was reduced as VL increased.

Figure 4B:
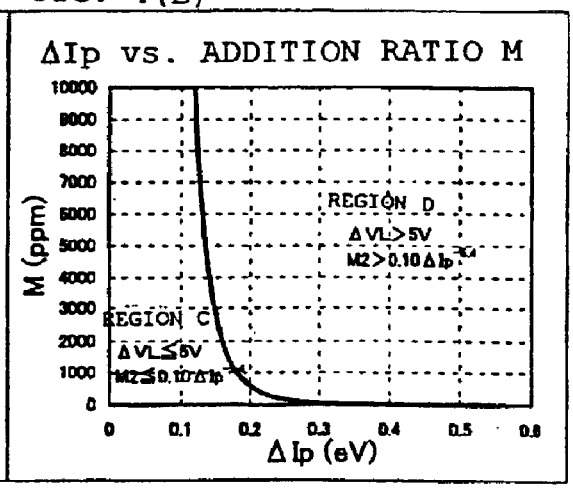
FIG. 4(B) is a view showing both a region C where the difference ΔVL of surface potentials which satisfies formula (2) is 5 V or smaller and a region D where the difference is greater than 5 V.

Moreover, the VL difference of the samples of Examples 4 to 8, which located in region C in FIG. 4(B) satisfying formula (2), and the samples of Reference examples 1 to 4, which comprised only CTM1 with no mixing, was below 5 V, and therefore a good image with no reduction of image concentration was obtained.

Figure 5:
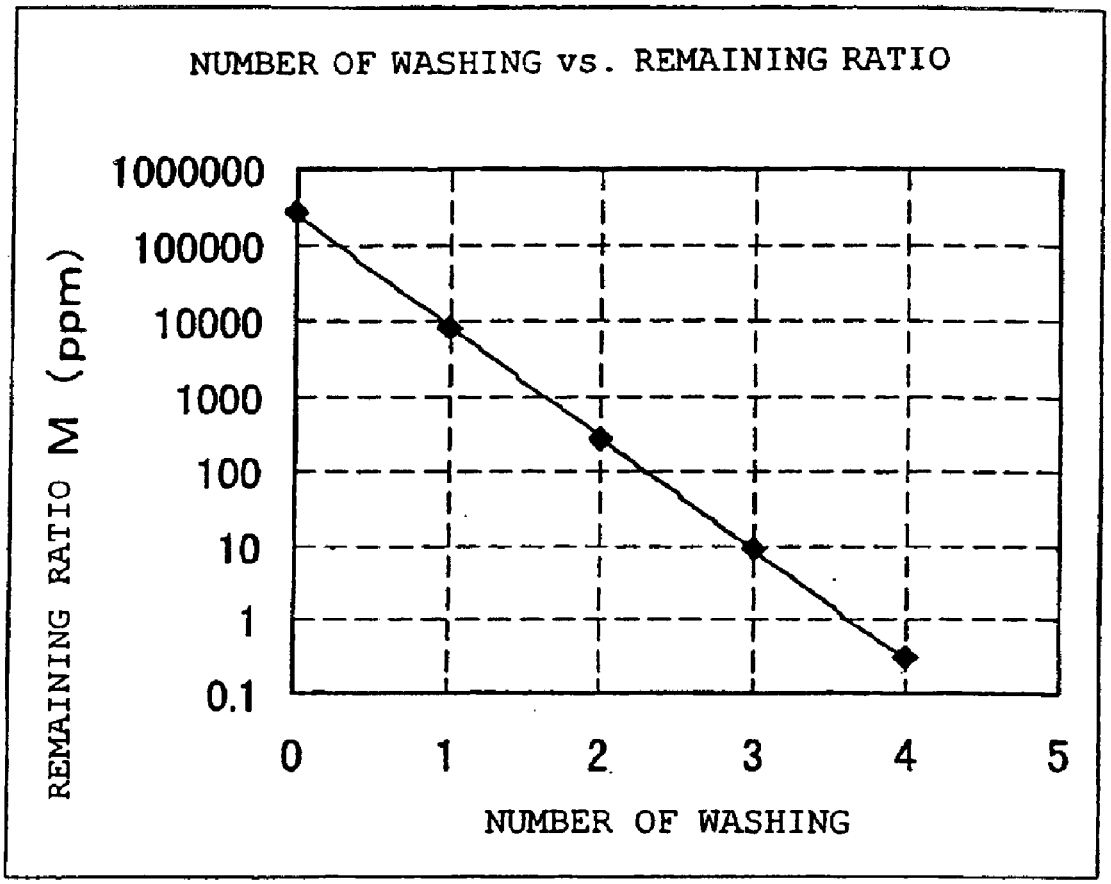
FIG. 5 is a view showing the relationship between the number of washing when a dip coating liquid is exchanged and the remaining ratio of a charge transporting material used in the previous production.

Next, after completion of dip coating in a production process, a washing operation in which a dip coating liquid was discharged, a washing solvent was poured and cycled in a dip coater and the washing solvent was then discharged, was carried out repeatedly to make an analysis between the number of washing and the mixed amount of a remaining charge transporting material. FIG. 5 shows the relationship between the number of washing when the dip coating liquid is exchanged and the remaining ratio of the charge transporting material used in the previous production. In the figure, the value of the washing number 0 represents the remaining ratio of the charge transporting material used in the previous production to the currently used charge transporting material in a case where, after the discharge of the previous dip coating liquid, a new dip coating liquid was poured without performing washing. The value of each of the washing numbers 1 to 4 represents the remaining ratio of the previous charge transporting material to the currently used charge transporting material in a case where a new dip coating liquid was poured after the above described washing operation was carried out 1 to 4 times, respectively. As the washing number increased, the remaining ratio decreased.

Figure 4C:
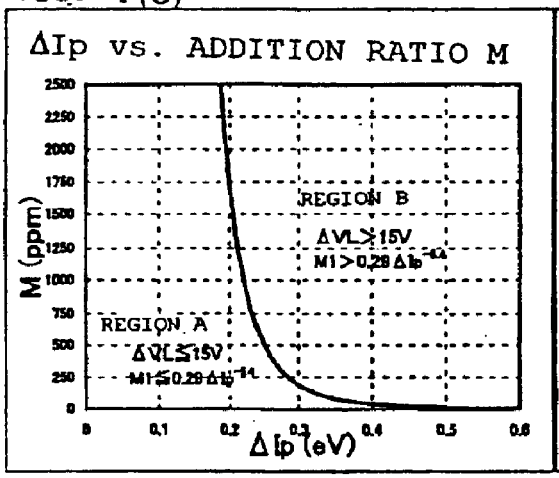
FIGS. 4(C) and 4(D) are views wherein the scale of M (ppm) is changed in FIGS. 4(A) and 4(B), respectively.

The formula (1) is obtained when an approximation curve is obtained by plotting the addition ratio M versus the ΔIp of each of Examples 1 to 3 where ΔVL=15 V. FIG. 5 shows that the remaining ratio of the charge transporting material used in the previous production was 270 ppm when washing was carried out twice. Considering these findings, FIG. 4(C) shows that, when applying a method for producing two or more types of electrophotographic photoreceptors using a single production apparatus and different charge transporting materials, in which the difference ΔIp between the ionization potential Ip(1) of a charge transporting material CTM1 and the smaller ionization potential Ip(2) of a charge transporting material CTM2 used in the previous production is set below 0.25 eV, the number of washing can be reduced when a dip coating liquid is exchanged and so the washing cost can be reduced even where the charge transporting material with small ionization potential contained in the previous dip coating liquid is possibly mixed in the current dip coating liquid, and an electrophotographic receptor, which retains good properties and has excellent resistance to ozone or nitrogen oxides, can be obtained.

Figure 4D:
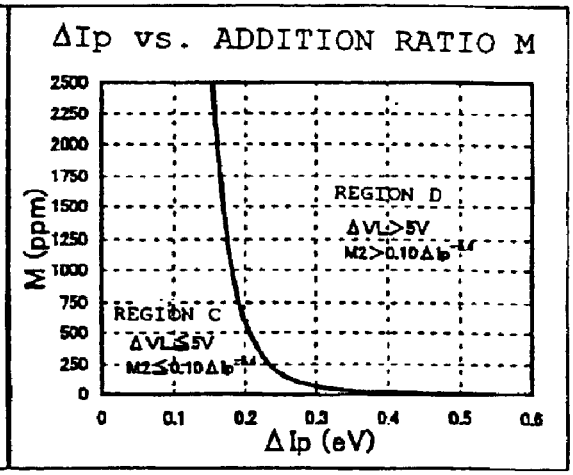

The formula (2) is obtained when an approximation curve is obtained by plotting the addition ratio M versus the ΔIp of each of Examples 4 to 8 where ΔVL=5 V. As described above, the remaining ratio of the charge transporting material used in the previous production was 270 ppm when washing was carried out twice. Considering these findings, FIG. 4(D) shows that, when applying a method for producing two or more types of electrophotographic photoreceptor using a single production apparatus and different charge transporting materials, in which the difference ΔIp between the ionization potential Ip(1) of a charge transporting material CTM1 and the smaller ionization potential Ip(2) of a charge transporting material CTM2 used in the previous production is set below 0.20 eV, the number of washing can be reduced when a dip coating liquid is exchanged and so the washing cost can be reduced even in a case where the charge transporting material with small ionization potential contained in the previous dip coating liquid is possibly mixed in the current dip coating liquid, and an electrophotographic receptor, which retains good properties and has excellent resistance to ozone or nitrogen oxides, can be obtained.

In the electrophotographic photoreceptor of the present invention, the increase of VL can be set below 15 V, if the ionization potential Ip(2) of a charge transporting material CTM2 is smaller than the ionization potential Ip(1) of a charge transporting material CTM1 in the constituents of a photosensitive layer, and the content ratio M (ppm) of the CTM2 to the CTM1 is set within a range represented by the formula (1) and thereby the reduction of image concentration is only a little; and the increase of VL can be set below 5 V, if the content ratio M (ppm) is set within a range represented by the formula (2), and thereby a stable image with no reduction of image concentration can be obtained.

In the production of the electrophotographic photoreceptor of the present invention, where the ionization potential of the charge transporting material in the previous production is small, ΔVL can be set below 15 V by using, in the next production, a dip coating liquid, which comprises, as a constitutive material, a charge transporting material in which the difference between the ionization potential of the current material and that of the previous material is set below 0.25 eV, and further, ΔVL can be set below 5 V by using a dip coating liquid, in which the difference is set below 0.20 eV.

Accordingly, even though washing is not sufficiently carried out and the charge transporting material with small ionization potential contained in the previous dip coating liquid is mixed in a new dip coating liquid, an electrophotographic photoreceptor which maintains its performance can be produced, so that the washing cost can be reduced.

What is claimed is:

1. An electrophotographic photoreceptor comprising a photosensitive layer, wherein, in the constituents of said photosensitive layer, the ionization potential Ip(2) of a charge transporting material CTM2 is smaller than the ionization potential Ip(1) of a charge transporting material CTM1, and the content ratio M1 (ppm) of the CTM2 to the CTM1 is within the range represented by the following formula (1), $$M1 \leqq 0.29 \times \Delta Ip^{-5.4} \quad \text{Formula (1)}$$

provided that M1 is less than 7500 ppm, ΔIp=Ip(1)−Ip(2), and Ip(1)>Ip(2).

2. An electrophotographic photoreceptor comprising a photosensitive layer, wherein, in the constituents of said photosensitive layer, the ionization potential Ip(2) of a charge transporting material CTM2 is smaller than the ionization potential Ip(1) of a charge transporting material CTM1, and the content ratio M2 (ppm) of the CTM2 to the CTM1 is within the range represented by the following formula (2), $$M2 \leqq 0.10 \times \Delta Ip^{-5.4} \quad \text{Formula (2)}$$

provided that M2 is less than 7500 ppm, ΔIp=Ip(1)−Ip(2), and Ip(1)>Ip(2).

3. The electrophotographic photoreceptor according to claim 1 or 2, wherein said photoreceptor comprises a photosensitive lamination consisting of least a charge generation layer and a charge transporting layer.

4. An electrophotographic photoreceptor comprising a photosensitive layer, wherein, in the constituents of said photosensitive layer, the ionization potential Ip(2) of a charge transporting material CTM2 is smaller than the ionization potential Ip(1) of a charge transporting material CTM1, and the content ratio M1 (ppm) of the CTM2 to the CTM1 is within the range represented by the following formula (1), $$M1 \leqq 0.29 \times \Delta Ip^{-5.4} \quad \text{formula (1)}$$

provided that ΔIp=Ip(1)−Ip(2), and Ip(1)>Ip(2), wherein said photoreceptor comprises an amine derivative represented by the following general formula [1] as the charge transporting material CTM1:

[Formula]

[1]

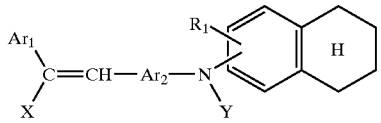

wherein $Ar_1$ shows an aryl group which may have a substituent, $Ar_2$ shows a phenylene, naphthylene, biphenylene, or anthrylene group which may have a substituent, $R_1$ shows a hydrogen atoms, lower alkyl group or lower alkoxy group, X shows a hydrogen atom, alkyl grop which may have a substituent, or aryl group which may have a substituent, and Y shows an aryl group which may have a substituent, or monovalent group represented by the following formula 2:

[Formula]

[2]

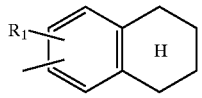

wherein $R_1$ shows the same group as described above.

5. A method for producing two or more different electrophotographic photoreceptors using different charge transporting materials in a single production apparatus, wherein the difference ΔIp between the ionization potential Ip(1) of a charge transporting material CTM1 and the smaller ionization potential Ip(2) of a charge transporting material CTM2 which has been used for the previous production, is represented by the following formula (3), $$\Delta Ip > 0.25 \text{ eV} \quad \text{Formula (3)}$$

provided that the content ratio M1 (ppm) of the CTM2 to the CTM1 is less than about 7500 ppm, ΔIp(1)−Ip(2) and Ip(1)>Ip(2).

6. A method for producing two or more different electrophotographic photoreceptors using a single production apparatus and different charge transporting materials, wherein the difference ΔIp between the ionization potent Ip(1) of a charge transporting material CTM1 and the smaller ionization potential Ip(2) of a charge transporting material CTM2 which is used for the previous production, is represented by the following formula (4), $$\Delta Ip > 0.20 \text{ eV} \quad \text{Formula (4)}$$

provided that the content ratio M2 (ppm) of the CTM2 to the CTM1 is less than about 7500 ppm, ΔIp(1)−Ip(2) and Ip(1)>Ip(2).

7. The method for producing an electrophotographic photoreceptor according to claim 5 or 6, wherein said photoreceptor comprises a photosensitive lamination consisting of at least a charge generation layer and a charge transport layer.

8. A method for producing two or more different electrophotographic photoreceptors using different charge transporting materials in a single production apparatus, wherein the difference ΔIp between the ionization potential Ip(1) of a charge transporting material CTM1 and the smaller ionization potential Ip(2) of a charge transporting material CTM2 which has been used for the previous production, is represented by the following formula (3), $$\Delta Ip \leqq 0.25 \text{ eV} \qquad \text{Formula (3)}$$

provided that ΔIp=Ip(1)−Ip(2) and Ip(1)>Ip(2), wherein said photoreceptor comprises an amine derivative represented by the following general formula [1] as the charge transporting material CTM1:

[Formula]

[1]

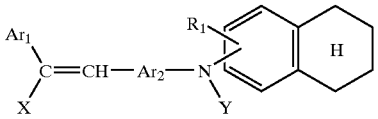

wherein $Ar_1$ shows an aryl group which may have a substituent, $Ar_2$ shows a phenylene, naphthylene, biphenylene, or anthrylene group which may have a substituent, $R_1$ shows a hydrogen atoms, lower alkyl group or lower alkoxy group, X shows a hydrogen atom, alkyl grop which may have a substituent, or aryl group which may have a substituent, and Y shows an aryl group which may have a substituent, or monovalent group presented by the following formula [2]:

[Formula]

[2]

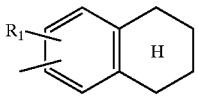

wherein $R_1$ shows the same group as described above.

9. An electrophotographic photoreceptor comprising a photo sensitive layer, wherein, in the constituents of said photosensitive layer, the ionization potential Ip(2) of a charge transporting material CTM2 is smaller than the ionization potential Ip(1) of a charge transporting material CTM1, and the content ratio M2 (ppm) of the CTM2 to the CTM1 is within the range represented by the following formula (2), $$M2 \leqq 0.10 \times \Delta Ip^{-5.4} \qquad \text{Formula (2)}$$

provided that ΔIp=Ip(1)−Ip(2), and Ip(1)>Ip(2), wherein said photoreceptor comprises an amine derivative represented by the following general formula [1] as the charge transporting material CTM1:

[Formula]

[1]

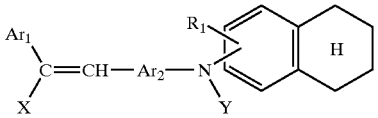

wherein $Ar_1$ shows an aryl group which may have a substituent, $Ar_2$ shows a phenylene, naphthylene, biphenylene, or anthrylene group which may have a substituent, $R_1$ shows a hydrogen atoms, lower alkyl group or lower alkoxy group, X shows a hydrogen atom, alkyl group which may have a substituent, or aryl group which may have a substituent, and Y shows an aryl group which may have a substituent, or monovalent group represented by the following formula [2]:

[Formula]

[2]

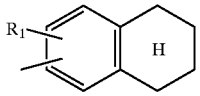

wherein $R_1$ shows the same group as described above.

10. A method for producing two or more different electrophotographic photoreceptors using a single production apparatus and different charge transporting materials, wherein the difference ΔIp between the ionization potential Ip(1) of a charge transporting material CTM1 and the smaller ionization potential Ip(2) of a charge transporting material CTM2 which is used for the previous production, is represented by the following formula (4), $$\Delta Ip \leqq 0.20 \text{ eV} \qquad \text{Formula (4)}$$

provided that ΔIp=Ip(1)−Ip(2) and Ip(1)>Ip(2), wherein said photoreceptor comprises an amine derivative represented by the following general formula [1] as the charge transporting material CTM1:

[Formula]

[1]

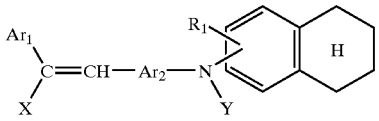

wherein $Ar_1$ shows an aryl group which may have a substituent, $Ar_2$ shows a phenylene, naphthylene, biphenylene, anthrylene group which may have a substituent, $R_1$ shows a hydrogen atoms, lower alkyl group or lower alkoxy group, X shows a hydrogen atom, alkyl grop which may have a substituent, or aryl group which may have a substituent, and Y shows an aryl group which may have a substituent, or monovalent group represented by the following formula [2]:

[Formula]

[2]

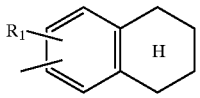

wherein $R_1$ shows the same group as described above.

* * * * *